US007059332B2

(12) United States Patent
Eli

(10) Patent No.: US 7,059,332 B2
(45) Date of Patent: Jun. 13, 2006

(54) DYNAMIC ORAL-EXERCISE METHOD

(76) Inventor: Bradley A. Eli, P.O. Box 234213, Encinitas, CA (US) 92023

( * ) Notice: Subject to any disclaimer, the term of this patent is extended or adjusted under 35 U.S.C. 154(b) by 0 days.

(21) Appl. No.: 10/948,058

(22) Filed: Sep. 23, 2004

(65) Prior Publication Data

US 2006/0060208 A1 Mar. 23, 2006

(51) Int. Cl.
*A63B 23/25* (2006.01)
*A61B 19/00* (2006.01)
*A61A 1/00* (2006.01)

(52) U.S. Cl. ..... 128/898; 482/11; 601/38

(58) Field of Classification Search ..... 482/11, 482/13; 433/68, 69, 140; 128/898; 601/38
See application file for complete search history.

(56) References Cited

U.S. PATENT DOCUMENTS 2,154,148 A * 4/1939 Butts ..... 33/513
3,813,096 A * 5/1974 Welch ..... 482/11
4,195,833 A * 4/1980 Svendsen ..... 482/11
4,955,367 A * 9/1990 Homsy ..... 601/38
5,035,420 A * 7/1991 Beeuwkes et al. ..... 482/11
5,078,600 A * 1/1992 Austin ..... 433/73
5,169,316 A * 12/1992 Lorman et al. ..... 434/185
5,176,594 A * 1/1993 Lee ..... 482/11
5,361,506 A * 11/1994 Beeuwkes ..... 33/512
5,562,105 A * 10/1996 Syrop et al. ..... 128/845
5,622,492 A * 4/1997 Eli ..... 433/3
5,724,746 A * 3/1998 Mack ..... 33/514
5,746,703 A * 5/1998 Levatino ..... 601/38
6,361,475 B1 * 3/2002 Jobe ..... 482/11
6,431,231 B1 * 8/2002 Braaten et al. ..... 144/24.12
6,514,176 B1 * 2/2003 Norton ..... 482/11

OTHER PUBLICATIONS

Lucia, Victor O, "Modern Gnathological Concepts—Updated," Quintessence Publishing Co., Inc., 1983, Chicago, pp. 38-39 and 61-64.
Okeson, Jeffrey P., "Fundamentals of Occlusion and Temporomandibular Disorders", The C.V. Mosby Company, 1985, St. Louis, pp. 333-340.
Shore, Nathan Allen, "Temporomandibular Joint Dysfunction and Occlusal Equilibration", J.B. Lippincott Company, 1976 [Second Edition], Philadelphia, pp. 237-241.

* cited by examiner

*Primary Examiner*—Henry Bennett
*Assistant Examiner*—Dinnatia Doster-Greene
(74) *Attorney, Agent, or Firm*—Frank G. Morkunas

(57) ABSTRACT

A method of correcting parafunctional behavior of the mandibular complex by engaging in a vertical measurement of the mouth followed by stretching open the mouth even further at least once followed by inserting an anti-occluding device between the teeth and retaining it there for a predetermined period of time then removing it and stretching the mouth wide open at least once. This method also may entail placing the tongue on the roof of the mouth [defined as the N-position] and keeping it there while opening and closing the mouth several times after which the mouth is opened to its maximum extent and then closed until the lips touch but the teeth do not touch. This position and the N-position are maintained for as long as possible and performed several times daily.

14 Claims, No Drawings

DYNAMIC ORAL-EXERCISE METHOD

CROSS REFERENCES TO RELATED APPLICATIONS

None.

STATEMENT REGARDING FEDERALLY-SPONSORED RESEARCH OR DEVELOPMENT

Not applicable.

BACKGROUND OF THE INVENTION

This present invention relates to an improvement in oral therapy, and more particularly to a comprehensive and dynamic approach to oral therapy addressing Temporomandibular Disorders [TMD], Temporomandibular Joint Disorders [TMJ], headaches, parafunctional behavior of the mandibular complex, and their inter-relationship with one another.

Headache is a multifactorial disorder which is a recurring, disabling event affecting a very functional and largely compliant population. Numerous articles, professional and lay, propounding various treatment options have been written through the years. These include medication management strategies both abortive and prophylactic, suffering-based management strategies and their reduction such as biofeedback and relaxation training, non-drug therapy including acupuncture, muscle therapies including both avoidance agents and specific paralyzing agents.

Experience and studies of the headache phenomenon and the various aspects of treatment have shown headache disorders to be slowly progressive with many individuals reporting initial infrequent headache events that, over time, increase in frequency, intensity, and duration. This is often associated with increasing medication use and has been identified as a specific subcategory termed analgesic rebound. It is also known that this rebound phenomenon is not limited to analgesic agents but has been discerned in the presence of many other agents.

It has been found that treatment of headache with a soft dental splint is an effective non-invasive therapy for migraine and tension vascular headaches [Lucia, "Modern Gnathological Concepts—Updated" (Quintessence Publishing Co., Inc., Chicago, 1983), page 64]. In one study, 39 of 53 headache patients who had been diagnosed and referred for treatment by a neurologist reported a marked improvement in their headache symptoms after treatment with a soft occlusal splint for night wear or extended wear and 18 of 22 of patients with migraine or vascular tension headaches reported an improvement [Id., at page 64]. What follows is a brief description of several types of oral splints which also may serve as an ancillary to a headache regimen and, more importantly, to a comprehensive oral-therapy strategy.

Typically, localized occlusal interference splints [LOIS] for the mouth are appliances suited for persons who habitually clench their teeth or who are bruxists [clinical symptoms of Temporomandibular Disorders (TMD)]. These splints function by overloading the periodontal receptors of two teeth in an arch thereby reflexly reducing the muscle force generated by the person experiencing TMD. The main function of this type of splint is as a 'habit breaker.' It is best to wear this type of splint at night though it may be worn at any time when the person is aware of a parafunctional disorder or habit. The splints can be worn for short periods of time on an as-needed basis [Id., at page 39].

A similar type of splint is an occlusal splint which also is a removable appliance which fits over the occlusal and incisal surfaces of the teeth in one arch creating precise occlusal contact with the teeth of the opposing arch. It is commonly referred to as a bite guard, night guard, interocclusal appliance, or orthopedic device. This type of splint typically can be used [1] to provide a more stable or functional joint position; [2] to introduce an optimum occlusal condition which reorganizes the neuromuscular reflex activity; or [3] to protect the teeth and supportive structures from abnormal forces which may create breakdown or tooth wear or both. [Okeson, "Fundamentals of Occlusion and Temporomandibular Disroders" (The C. V. Mosby Company, St. Louis, 1985), page 333] Splint therapy has also been used for treatment of Temporomandibular Disorders [TMD]. Protuberances of approximately 4 mm in width have also been placed at the anterior arches of the occlusal surfaces of such splints to act as anterior stops for the splint. [Id., at page 337] Such stops are generally flat and perpendicular to the long axis of the contacting mandibular incisor and should extend to where a mandibular anterior central incisor will contact [Id., at page 340].

Temporomandibular Joint Disorders [TMJ] can cause headaches, jaw clenching, and bruxism [side-to-side grinding of teeth]. Some headaches are related to problems with the temporal mandibular joint. It has been shown that a mouth-bite splint can be fashioned to prevent a person from clenching and realizing the various symptoms of TMJ and, in particular, soft bite guards which better absorb occlusal forces by virtue of their soft nature and aid in TMD and TMJ therapy [Lucia, "Modern Gnathological Concepts—Updated" (Quintessence Publishing Co., Inc., Chicago, 1983), page 38].

The Shore Mandibular Autorepositioning Appliance [SMAA] is another appliance which can aid in TMJ and TMD therapy. It was developed in approximately 1960. The SMAA frees the mandible from malocclusion and transmits the force of mandibular closure through the teeth to the maxilla thus removing pressures from the traumatized joints. In making the SMAA, a temporarily incorrect functional occlusion is created in acrylic. An acrylic-plate cast is made for the upper teeth, fitted to the person's teeth. An acrylic ramp [protuberance] approximately 3 mm thick is fabricated on the lingual aspect of the central incisors [similar to that discussed above with a 4 mm anterior stop [protuberance]; Shore refers to the anti-occluder [protuberance] as a "ramp"]. The acrylic plate cover the palatal surface and the ramp acts as the splint [anti-occluder]. The ramp must be such that there is a clearance between the upper and lower posterior teeth to thereby prevent their respective occlusion [Shore, "Temporomandibular Joint Dysfunction and Occlusal Equilibration" (J.L. Lippincott Company, Philadelphia, Second Ed., 1976), pages 238–241].

Over the past 10 years, there have been a number of other specific and unique, if not unconventional, new treatments proposed for headaches, and research and treatment innovations continue. As interest grows and more people suffer or become more acutely aware, solutions and treatments are sought and, thereby, continue to evolve. No one to date has considered a comprehensive approach which encompasses and addresses the mandibular complex as it relates to various mandibular disorders and headaches.

Recently specific muscle agents, such as botulinum toxin, are being discussed and utilized. Use of such muscle agents for treatment of headaches is extremely expensive and, notwithstanding, currently is on the rise. This care plan is associated with reduction of headache frequency and, although expensive, enjoys some cost-efficacy due to a reduction in office visits, reduction in visits to urgent-care facilities, and a reduction in one's medication regimen and its associated costs. Unfortunately, botulinum toxin's duration of action is limited to three to four months and often requires repeat and continued care. There is also significant injector-variability making outcomes inconsistent. Total volumes and locations have also been largely variable making some literature question this care. Mild complications have begun to arise, including volumetric loss of muscle in frequently repeated injection sites.

In spite of this growing interest and concern, what remains missing from the equation is the comprehensive approach and strategy taking into account the various causes and effects, direct and indirect, associated with headache, TMD, and TMJ. A more dynamic approach and strategy is needed for directive and cost-effective therapy plans. This is notable in both drug and non-drug therapy plans.

Prior to any headache treatment strategy or any comprehensive oral-therapy regimen for that matter, clear goals of care must be assessed and discussed which include headache frequency reduction, extent [if any] of TMJ or TMD, an exercise regimen, elimination of urgent care and emergency department utilization, and positive impacts on intensity and duration.

The system envisioned by the present invention fills the void in the prior art and is designed to be included in existing treatment plans for headaches, TMD, TMJ, and other parafunctional behaviors of the mandibular complex, to reduce or eliminate the muscle component present in all such disorders. For headaches, its availability may be included in both migrainous and non-migrainous headache populations and available to all levels of frequency. Use of the system envisioned by the present invention would have a positive impact and reduce the need for additional care or frequency of such care and costs associated with such care by professional care givers.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates the care, treatment, and exercise regimen as a complement to one another for headache and facial pain associated with the muscles of the related musculature.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

There are no drawings.

DETAILED DESCRIPTION OF THE INVENTION

As used herein any pronoun references to gender [e.g., he, her, she, him, etc.] are meant to be gender-neutral and are so used for administrative clarity and convenience. Additionally, any use of the singular or to the plural shall also be construed to refer to the plural or to the singular, respectively, as warranted by the context in which used.

The first step in this process is to perform a measurement of the person's mouth in a normal-open position; i.e., a normal opening without forcing the mouth or stretching the mouth open any wider. Normal exertion to execute a normal, vertically opened mouth. A mouth-open measurement is performed. Any suitable measuring device may be used, including, but not limited to, a conventional ruler [in standard or metric], a compass, a caliper, or a measuring device as described in my prior patent, U.S. Pat. No. 5,622,492, for a dental mirror handle. To this end, even a dowel rod, pencil, or any relatively straight rod-like object or writing implement may be used. If such an unmarked [no measuring indicia thereon] device is used, the user should place the bottom of the object on the biting edge of the user's upper or lower teeth, open his mouth normally, and then mark the spot on the object to which his opposing arch biting edge reaches. This 'marking' could be with any suitable marking means to include a pen or pencil mark or a scratch, nick or cut into the object, or taping the points. The 'marking' also could be by memory, though not advisable unless the dental mirror handle is used. This marking establishes a reference point on the device for the user's open-mouth opening; a point which should be exceeded when engaging in the stretching phase [as described below].

The patented device is preferable, though not mandated, however, as it has a mirror and pre-defined measuring indicia enabling the user or professional care-giver to examine the oral cavity for signs of decay or other abnormality as well and perform the measurement function. The specification of that patent is hereby incorporated by reference thereto. If this device is used, reference points must also be established for the open-mouth opening by marking or taping, for example, of the device.

In whatever manner a measurement is taken of the normal-open mouth, the follow-on measurements must follow the same protocol or measure points. A normal-open mouth opening is generally about 40–45 mm. In other words, regardless of what measure points are selected by the user, all follow-on measurements should use the same measure points.

After the open-mouth is measured and noted or marked on the measuring device, the user than initiates one or more mouth and jaw stretches. A mouth and jaw stretch is a process whereby the user opens their mouth at least as wide or wider than the normal-open mouth opening at which the first measurement was taken. The measuring device previously used by the user to measure the normal-open mouth opening, with its reference points, should also be used to ensure that the stretched-open mouth opening exceeds the routine-open mouth opening. It is important in the stretch phase that the user does in fact open his mouth wider than the mouth was opened in the routine-open mouth sequence. It is most beneficial if the user can exceed the "normal-open" mouth opening by at least approximately 10%, or to a level to effect a stretch of the related musculature without causing dysfunction or discomfort.

In many cases, a user can generally tell whether or not in the stretch phase he exceeds the opening of the routine-open mouth phase. In other cases, such may not be as easily discernible. In such cases, the measuring device is placed on one of its reference points, with the open-mouth mark easily visible, and the user then initiates the stretch phase, generally in front of a mirror or by use of the dental mirror handle, and stretches until the open-mouth mark is exceeded.

As stated above, at least one such stretch is required, but two or more would greatly enhance the desired effects of such stretching. This portion of the care and exercise plan is intended to assist the muscles in maintaining a lesser state of resting tension, promote improved blood flow and maintain the person in an active ongoing treatment plan for their disorder.

The next step in this process is the anti-occlusion phase. The user must now insert an anti-occlusion device into their mouth to prevent the occluding of their posterior and anterior teeth. Such a device may be any one of the devices described previously in the Background section of this application or may simply be any object capable of preventing the user from occluding his teeth. If this phase is performed during waking hours, a pencil, pen, dowel rod, eraser, hard or soft candy, for example, may suffice. The purpose during this phase is to prevent the user from occluding their teeth for a predetermined period of time or provide a negative reinforcement to such behavior. For extended periods or during sleep, naturally a pre-formed device, such as those described previously, are mandated for safety and comfort. For good results, it is best that the anti-occlusion phase be maintained for at least one hour.

The function of this phase is to maintain a item between the users teeth to reinforce the importance of tooth contact avoidance. It is best that this portion of the exercise plan be employed during the hours of sleep whereby the users are instructed to insert the device upon retiring to bed for the night, or during their sleep cycle. This phase may also be employed during a user's conscious times but such may not always be practicable nor feasible and thereby diminish the effects of this phase.

After the pre-determined time has expired, the user may remove the anti-occluder device. The next step is to engage in the stretch phase again as previously described. All phases, except the open-mouth measurement phase, are repeated as necessary, as dictated by a care-giver, or until the user realizes some positive results.

As described above, a user may employ any suitable device for the measurement phase, the stretching phase, and the anti-occlusion phase. It is, however, best if specifically designed instruments and devices are used, as indicated above for the measurement device and for the anti-occluding device. This ensures, or at a minimum facilitates, proper use of the devices and proper execution of the method steps for maximum results. It is recommended that a user consult a professional [i.e., a health-care provider trained in or familiar with headache, parafunctional behavior of the mandibular complex, TMD, and TMJ and proper use of anti-occluding devices] to determine, first and foremost, if a user is suitable for this type of exercise and then to outline a regimen of use, duration of the anti-occlusion phase best suited for the user, number repetitions of the phases, duration of the exercise, health and safety aspects of the therapy regimen, care and sanitation of the therapy and associated devices, and follow-on consultation to assess continuation or discontinuation of the therapy.

It is best that a person engage in this type of exercise at least once per day particularly if done during the hours of sleep with the anti-occluding device in place. This ensures a long period of time for the anti-occlusion phase which will yield the most beneficial results. If done during non-sleep, conscious hours, since generally the anti-occlusion phase will not be as long as it would be during the hours of sleep; twice is better; and, as with all exercise and therapy regimens, multiple times daily is even better. It is also best that a person engage in this type of exercise for more than one day and continue such on a routine and daily basis for days, week, and, as necessary, months.

To further enhance the benefits of this inventive process, it is best to engage in a series of daily exercises referred to herein as the hold position or hold phase, several times daily, involving the mouth, lips, tongue, roof of the mouth, and teeth. This exercise routine requires the user to place his tongue on the roof of his mouth and to maintain the tongue thereat. The placement of the tongue is similar to the tongue's position when it touches, or nearly touches, the roof of the mouth when the person enunciates any one of the following letters: C, D*, G*, J*, L*, N*, S, T*, W*, and Z, for example [asterisks denote the letters which generally require an actually touching of the tongue to the roof of the mouth, either at the initiation or termination of the enunciation of the respective letter]. This, tongue touching the tongue and maintaining the tongue at the roof of the mouth, will be referred to herein as the N-position.

While holding the N-position, the person should then gently open and close his mouth several times. Generally a minimum of at least 5 such openings and closings [i.e., repetitions] should be executed; as with all exercise, more is even better. Completing the repetitions, regardless of how many, is referred to as a series. The person should not permit his upper teeth to touch any lower teeth during each repetition. After completing the series, the next phase is for the person to then open his mouth as wide as he possibly can [while still maintaining the N-position] followed then by slowly closing his mouth, with lips relaxed, until the upper and lower lips, but not the upper and lower teeth, touch. This position, with lips touching, teeth not touching, while maintaining the N-position should be held by the person for as long as he possibly can maintain that position.

It is best that a person engage in this hold phase at least once per day; twice is better; and, as with all exercise and therapy regimens, multiple times daily is even better. It is also best, and to maximize the benefits, that a person engage in this type of exercise for more than one day and continue such on a routine and daily basis for days, week, and, as necessary, months.

The present disclosure includes that contained in the present claims as well as that of the foregoing description. Although this invention has been described in its preferred forms with a certain degree of particularity, it is understood that the present disclosure of the preferred steps has been made only by way of example and numerous changes in the details of method steps may be resorted to without departing from the spirit and scope of the invention. Accordingly, the scope of the invention should be determined not by the description set forth herein, but by the appended claims and their legal equivalents.

The invention claimed is:

1. A oral-exercise method of correcting parafunctional behavior of the mandibular complex comprising:

(a) engaging in a measurement phase by conducting a vertical measurement of an opening created by a person's mouth when said mouth is normally opened thereby defining a normal-open mouth position;

(b) engaging in a stretching phase by stretching open at least one time said person's mouth beyond said normal-open mouth position thereby defining s stretched-open position;

(c) engaging in an anti-occlusion phase by inserting an anti-occluding device between said person's upper and lower-teeth and retaining said anti-occluding device between said person's upper and lower teeth for a pre-determined period of time;

(d) removing said anti-occluding device;

(e) engaging in said stretching phase; and (f) engaging in a hold phase wherein said hold phase involves said person's teeth, tongue, lips, and roof of mouth and comprises placing the tongue on the roof of the mouth and keeping the tongue thereat thereby defining an N-position; opening and closing the mouth several times while maintaining the N-position thereby defining a series; after completion of said series, opening said mouth to the maximum extent while maintaining the N-position; closing said mouth until the lips touch but the teeth do not touch thereby defining a lips-touched position; and maintaining said lips-touched position for as long as possible.

2. The method as claimed in claim 1 further comprises repeating method steps (b) through (e) of claim 1 more than once daily.

3. The method as claimed in claim 1 further comprises repeating method steps (b) through (e) of claim 1 daily for more than one day.

4. The method as claimed in claim 1 wherein said stretched-open position should exceed said normal-open position.

5. The method as claimed in claim 1 further comprises establishing at least two reference points for said normal-open mouth position on a measuring device and using said reference points as a guide to ensure said stretched-open position exceeds said normal-open position during said stretching phase.

6. The method as claimed in claim 5 wherein said measuring device is substantially straight and is selected from the group consisting of dental mirror handles, writing implements, dowel rods, calipers, compasses, and rulers.

7. The method as claimed in claim 1 wherein said anti-occluding device is selected from the group consisting of dental splints, bite guards, mouth pieces, dental mouth trays, anterior stop devices, and any combinations thereof.

8. The method as claimed in claim 1 wherein said series comprises said opening and said closing of the mouth between 5 and 15 times and avoiding teeth contact during said opening and said closing of the mouth.

9. The method as claimed in claim 1 further comprising initiating more than one said series daily.

10. The method as claimed in claim 1 further comprising initiating said hold phase daily for more than one day.

11. A oral-exercise method involving a person's teeth, tongue, lips, and roof of mouth, of correcting parafunctional behavior of the mandibular complex, said method comprising:

(a) first placing the tongue on the roof of the mouth and keeping the tongue thereat thereby defining an N-position;

(b) followed by opening and closing the mouth several times while maintaining the N-position thereby defining a series;

(c) after completion of said series, opening said mouth to the maximum extent while maintaining the N-position;

(d) after completion of step (a) closing said mouth until the lips touch but the teeth do not touch thereby defining a lips-touched position; and (e) maintaining said lips-touched position for as long as possible.

12. The method as claimed in claim 11 wherein said series comprises said opening and said closing of the mouth between 5 and 15 times and avoiding teeth contact during said opening and said closing of the mouth.

13. The method as claimed in claim 11 further comprising initiating more than one said series daily.

14. The method as claimed in claim 11 further comprising initiating said oral-exercise method daily for more than one day.

* * * * *